US005080511A

United States Patent [19]

Iwata

[11] Patent Number: 5,080,511

[45] Date of Patent: Jan. 14, 1992

[54] SERIAL TYPE COLOR PRINTER USED WITH INK RIBBON CASSETTE

[75] Inventor: Kiyohide Iwata, Shimizu, Japan

[73] Assignee: Star Seimitsu Kabushiki Kaisha, Japan

[21] Appl. No.: 283,323

[22] PCT Filed: Apr. 13, 1988

[86] PCT No.: PCT/JP88/00366

§ 371 Date: Nov. 23, 1988

§ 102(e) Date: Nov. 23, 1988

[87] PCT Pub. No.: WO88/07936

PCT Pub. Date: Oct. 20, 1988

[30] Foreign Application Priority Data

Apr. 13, 1987 [JP] Japan ..... 62-88877
Apr. 13, 1987 [JP] Japan ..... 62-88878

[51] Int. Cl.[5] ..... B41J 35/14
[52] U.S. Cl. ..... 400/216.1; 400/216.2
[58] Field of Search ..... 400/216.2, 216.1, 216.3, 400/216

[56] References Cited

U.S. PATENT DOCUMENTS 4,280,767 7/1981 Heath ..... 400/216.2
4,368,993 1/1983 Brass ..... 400/216.2
4,697,942 10/1987 Yagi et al. ..... 400/216.1

FOREIGN PATENT DOCUMENTS 78685 4/1986 Japan ..... 400/216.2
175069 8/1986 Japan ..... 400/247
0274977 12/1986 Japan ..... 400/216.2

*Primary Examiner*—Edgar S. Burr
*Assistant Examiner*—John S. Hilten
*Attorney, Agent, or Firm*—Bruce L. Adams; Van C. Wilks

[57] ABSTRACT

A serial color printer equipped with a cassette holder (3) that carries an ink ribbon cassette (3) dismountably on a carriage (2) of a printing head, and is tiltably mounted on said carriage (2) so that the ink ribbon may be moved in a direction vertical to said platen. The ink ribbon (7) includes a plurality of longitudinally parallel color regions, and can change the color adapted to the print line along with the movement of the cassette (3). The cassette holder (3) is connected operationally to a tilt arrangement, and the tilt arrangement is equipped with a cam mechanism (12, 15) mounted on the carriage (2), and a drive mechanism for driving said cam mechanism in conjunction with the carriage (2). The respective home positions of the carriage (2) and the cassette holder (3) are discerned by a single position sensor, and when the carriage (2) and the cassette holder (3) are in positions other than the home positions, the initial setting process of moving them to the home positions is carried out.

2 Claims, 4 Drawing Sheets

SERIAL TYPE COLOR PRINTER USED WITH INK RIBBON CASSETTE

FIELD OF THE INVENTION

The present invention relates to a serial printer having a printing head movable along a platen, and more particularly to a color printer equipped with a shift apparatus for an ink ribbon having a plurality of longitudinally parallel color regions. The present invention can be applied to a printer of the type that is used with an ink ribbon held in a cassette or a cartridge, such as a wire dot matrix printer, and a heat sensitive transfer printer.

The ink ribbon cassette containing an ink ribbon with a plurality of longitudinally parallel color regions, for example, yellow, cyan, magenta, and black belt-shaped sections is well known, and in a color printer equipped with such an ink ribbon cassette, the ink ribbon cassette is mounted tiltably on the carriage of the printing head, the ink ribbon is shifted perpendicularly to the length of the ink ribbon along with the movement of the cassette, and thereby the desired color region will be adapted to the print line.

DESCRIPTION OF THE PRIOR ART

The tilt arrangement of an ink ribbon cassette is used for changing the color of the color printer, and also is used for rendering the print line visible when the carriage is returned. As a tilt arrangement for rendering the print line visible, one disclosed in U.S. Pat. No. 4,636,098 issued on Jan. 13, 1987 is known, and in this arrangement, a single stepper motor is mounted on the carriage of the printing head, drives the ink ribbon when the carriage is advanced and acts to tilt the cassette when the carriage is returned. In the tilt arrangement for changing the color in a color printer, it was general that a power source independent of the stepper motor for advancing the ink ribbon is provided. However, since this method makes the cost of the apparatus high, it was suggested that the cassette is tilted by a cam mechanism that is operated in connection with the movement of the carriage. In such an tilt arrangement, for example, in the tilt arrangement disclosed in Japanese Patent Laid-Open (Kokai) No. 71690/1987 published on Apr. 2, 1987, together with a cam wheel, a ratchet wheel is pivotally mounted on the carriage, when the carriage reaches a specified operating position beyond the terminal position, the control lever mounted on the frame moves the cam wheel together with the ratchet wheel angularly thereby causing the cassette holder with a cam follower to tilt.

In a color printer that can shift the color of the ink ribbon by the cassette tilt arrangement including a cam mechanism that operates in connection with the movement of the carriage of the printing head, it is required that both the home position of the carriage and the home position of the cassette holder are detected precisely thereby controlling the movement of the carriage. The home position of the carriage is set at the central position or the terminal position on the one side of the frame, and the carriage is operated with the home position as the starting point. The home position of the cassette holder is set at the tilt position where a specified color region on the ink ribbon of the ink ribbon cassette secured to said holder is adapted on the print line, and the color is changed using the home position as the starting point. Conventionally, separate sensors are arranged to these home positions, and when the carriage and/or the cassette holder are positioned in the corresponding home positions, the sensors related to them are operated. As the sensor, use is made of a transmission type photo-interprepter, a reflective type photo-interpreter, or a microswitch.

SUMMARY OF THE INVENTION

An object of the invention is to provide a serial type printer that is used together with an ink ribbon cassette wherein a cassette holder is provided for tiltably mounting the ink ribbon cassette on a carriage of a printing head, and the cassette holder is mounted on said carriage, and is moved by a tilt arrangement including a cam mechanism that operates in conjunction with the movement of said carriage.

Another object of the invention is to provide a serial type color printer having a tilt arrangement of an ink ribbon cassette that can discern the detection whether a carriage of a printing head is in the home position of said carriage, and whether an ink ribbon cassette holder provided on said carriage is in the home position of said holder by a single sensor.

DESCRIPTION OF THE PREFERRED EMBODIMENT

Figure 1:
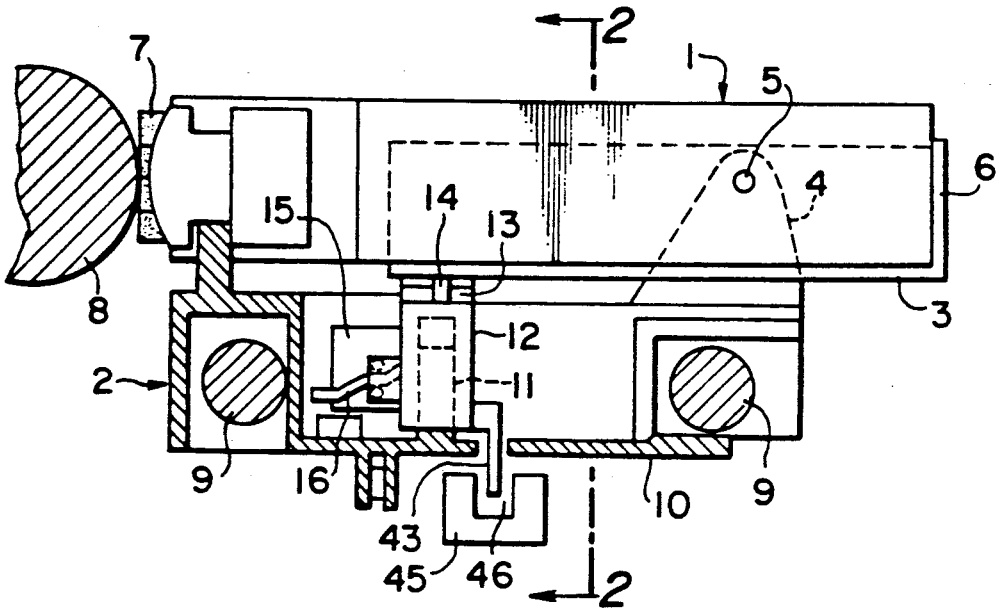
FIG. 1 is a side view illustrating a serial printer equipped with a tilt arrangement of an ink ribbon cassette.

Referring to FIG. 1, an ink ribbon cassette 1 is carried by a cassette holder 3 tiltably mounted on a carriage 2 of a printing head. The cassette holder 3 is pivotally attached to brackets 4 formed to the carriage 2 via a shaft 5, and can be rotated on the shaft 5. The ink ribbon cassette 1 is positioned by a shoulder section 6 provided to the cassette holder 3, and can be locked on the holder 3 in a known manner. The ink ribbon cassette 1 contains therein a color ink ribbon 7 having a plurality of longitudinally parallel color regions and part of the ink ribbon is led between a platen 8 and the printing head (not shown). The carriage 2 is mounted slidably on two shafts 9 extending in parallel with the platen 8, and can be reciprocated along the platen 8 by a suitable driving source (not shown).

Figure 2:
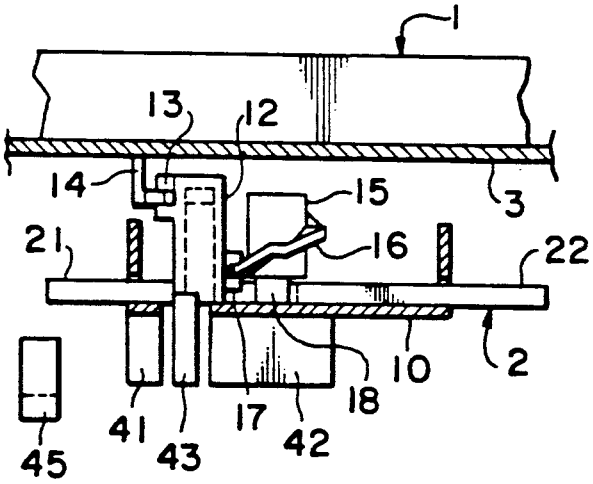
FIG. 2 is a crosssectional view taken along line 2—2 of FIG. 1.
Figure 3:
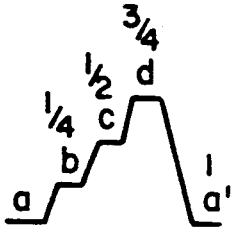
FIG. 3 is a view illustrating the operation of the cam shown in FIGS. 1 and 2.

The carriage 2 has a bottom plate 10, and on the bottom plate 10 is mounted a cassette tilt arrangement having a cam mechanism for lifting up the cassette holder 3, and a drive mechanism for driving the cam mechanism. Referring to FIG. 2 together with FIG. 1, the cam mechanism is provided with a cam wheel 15 having a spirally extending cam edge 16, and a cam follower 12 having a first lip 17 engaged with said cam edge 16, and a second lip 13 engaged with a leg 14 extending from the cassette holder 3. The cam follower 12 is formed into the shape of a cylinder, is supported slidably along a post 11 formed on the bottom plate 10, and will be moved axially of the post 11 upon the rotation of the cam wheel 15, thereby lifting up the cassette holder 3.

Figure 4A:
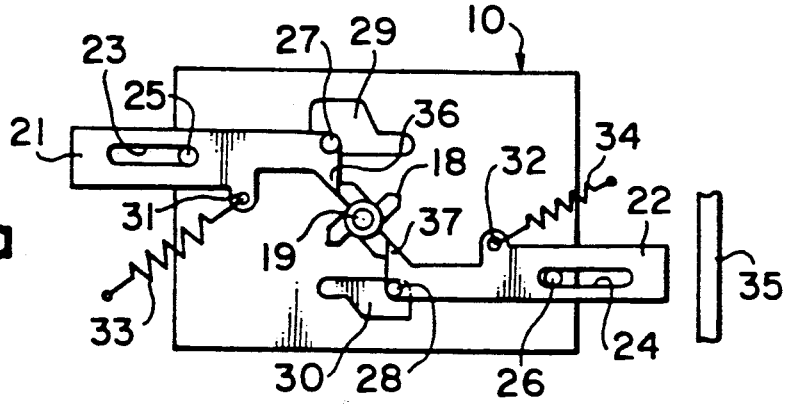
FIGS. 4*a*, 4*b*, 4*c*, and 4*d* are plane views illustrating the order of the operation of the cam drive mechanism.
Figure 4B:
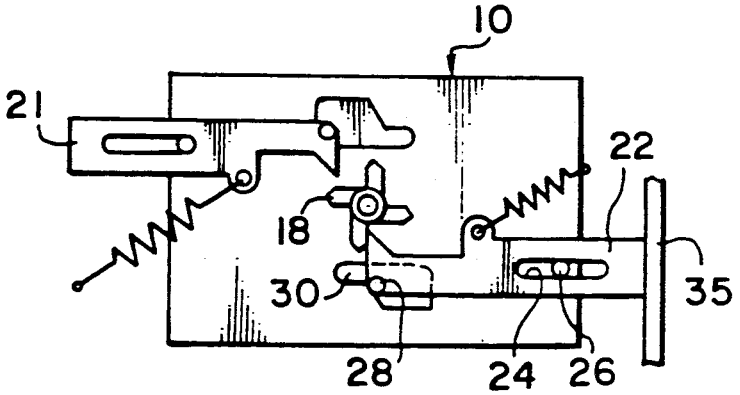

Referring to FIG. 4*a*, the cam drive mechanism is provided with a ratchet wheel 18 that is supported on a shaft 19 together with the cam wheel 15, and a pair of drive levers 21, and 22 for moving angularly the ratchet wheel 18. The ratchet wheel 18, in this instance, has four ratchets, and each of the ratchets is operationally engageable with a selected one of the pair of drive levers 21, and 22. The pair of drive levers 21, and 22 are arranged symmetrically on the opposite sides of the ratchet wheel 18, and have slots 23, and 24, and movable pins 27, and 28 respectively. The slots 23, and 24 are engaged with fixed pins 25, and 26 formed on the bottom plate 10 of the carriage, and the movable pins 27, and 28 are engaged with notch cams 29 , and 30 formed in said bottom plate 10. Springs 33, 34 are positioned between the drive levers 21, and 22 and the carriage 2 so that the drive levers 21, and 22 and the carriage 2 may be energized resiliently in opposite directions, and in the normal state, acting ends 36, 37 of the drive levers 21, and 22 occupy the positions where they are in contact with different ratchets of the ratchet wheel 18. On the other hand, at specified positions beyond the two end points of the operation of the carriage 2, abutting plates 35 are provided, with only one abutting plate 35 at one position being illustrated in the shown embodiment for the sake of convenience. When the carriage 2 is moved until the carriage 2 reaches the specified positions beyond the end points of the operation of the carriage 2, each of the abutting plates 25 abuts on other end of the drive lever 21 or 22 related to the abutting plate 35 thereby the abutting plate acts to slide said lever 21, or 22.

Figure 4C:
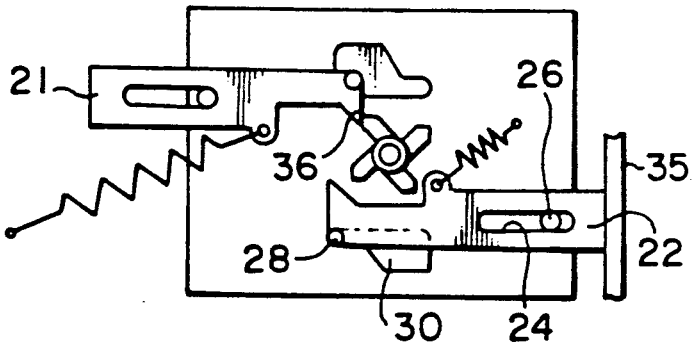
Figure 4D:
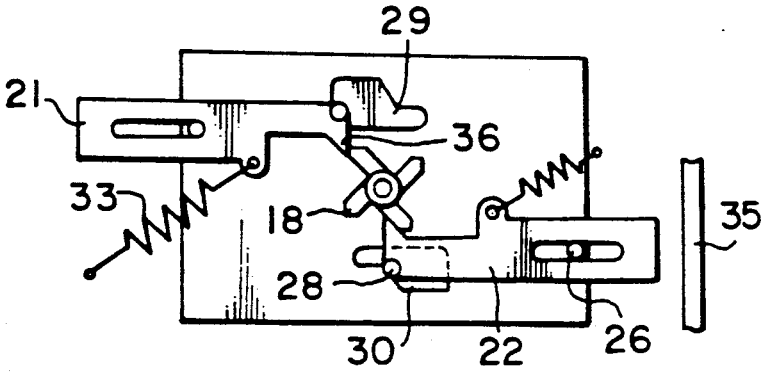

Referring to FIG. 4*a* to FIG. 4*d* in order, when the carriage 2 is moved to the specified position beyond the one end point of the operation, and then is returned from that position, the way the cam drive mechanism is operated with respect to the movement of the carriage 2 becomes apparent. That is, along with the movement of the carriage 2, the end of the one drive lever 22 abuts against the abutting plate 35, and when further the carriage 2 is moved, the drive lever 22 is slid against the reaction of the spring 34, and the acting end 37 of said lever 22 moves the ratchet wheel 18 angularly. In this case, the movable pin 28 engaged with the notch cam 30 prevents said acting end 37 from escaping from the ratchet wheel 18 (FIGS. 4*a* and 4*c*). When the carriage 2 is moved to the specified position and then is returned in its reverse direction, said one drive lever 22 is returned by the spring 34 to the normal position. In this case, the ratchet wheel 18 is in contact with the acting end 36 of the other drive lever 21, and since the other drive lever 21 serves as a stopper, the ratchet wheel 18 remains at the position where an increment has been added by the one drive lever 22. Further, when the one drive lever 22 is returned to the normal position, the acting end 37 must go beyond the next ratchet of the ratchet wheel 18, and such an operation is ensured by the movable pin 28 that can move freely in the notch 30 (FIG. 4*d*). It will be easily understood that the similar operation of the other drive lever 22 to this operation of said one drive lever 21 can be performed. As a result, the ink ribbon can be selectively shifted with respect to the specified positions beyond the both end points of the carriage 2.

Figure 8:
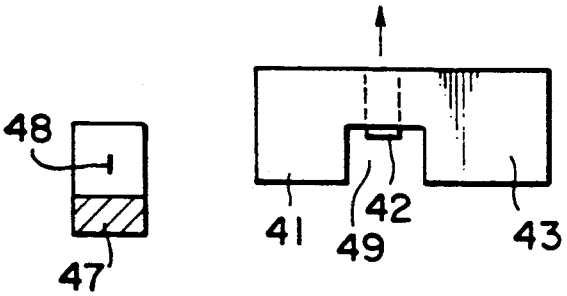
FIG. 8 is a side view illustrating a movable shutter that operates in connection with the tilt position of the cassette holder.

Referring to FIGS. 1 and 2 again, the bottom plate 10 of the carriage 2 has two downward extending shutter plates 41, and 43 with an interval between them, and a movable shutter plate 42 movable with the cam follower 12 can be extended between the first and the second shutter plates 41, and 43. In this instance, the lowest position of the cassette holder 3 is set as the home position, and when the cassette holder 13 is placed in the home position, then the movable shutter plate 42 is placed between the first and the second shutter plates 41, and 43, so that a gap 44 and a gap 45 (FIG. 5*a*) are formed between the movable shutter plate 42 and the shutter plates 41, and 43. In this case, when the cassette holder 3 is lifted up to a position other than the home position, the movable shutter plate 42 leaves from between the first and the second shutter plates 41, and 43 thereby forming a gap 49 only between them as shown in FIG. 8. On the other hand, a position sensor 47 is secured at a suitable position of a frame (not shown) related to the home position of the carriage 2. As the sensor 47 can be used, for example, a transmission type photo-interpreter, in which photo-interpreter a channel 46 through which the shutter plates 41, 42, and 43 can pass is formed, and a light source (not shown) and a photoelement 48 are arranged on the opposite sides of the channel 46.

According to the present invention, when from the nonoperating state of the position sensor 46, that is, from the state wherein the shutter is not present between the light source and the photoelement, three operated states are repeated by the three shutter plates 41, 42, and 43, then it is discerned that the carriage 2 and the cassette holder 3 are positioned at the respective home positions. The way this is carried out will be described below.

Figure 5A:
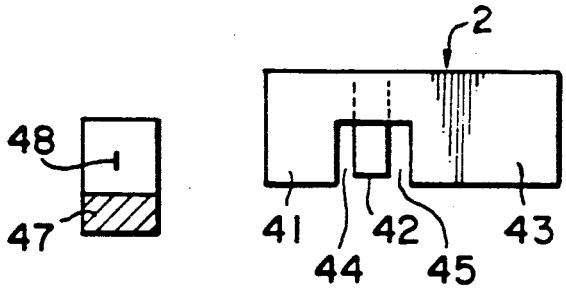
FIGS. 5*a*, and 5*b* are side views illustrating the way the carriage of the printing head situated away from the home position reaches the home position.
Figure 5B:
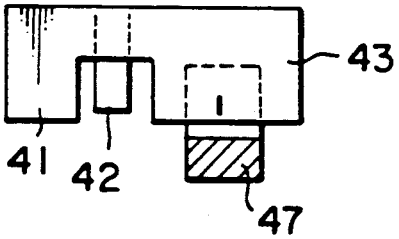

Although FIG. 5 shows the carriage 2 is positioned far away from the position sensor 47, in this case, for the sake of convenience of the explanation, the movable shutter plate 42 is positioned between the first and the second shutters 41, and 43, that is, the cassette holder 3 is already set initially in its home position. When the power source is switched on, and it is recognized that the position sensor 47 is in the nonoperating state, the control sequence of the position sensor 47 moves said carriage 2 toward the position sensor 47. As a result, the position sensor 47 senses the first shutter plate 41, and then the movable shutter plate 42 and the second shutter plate 43. In this case, the control sequence of the carriage 2 is programmed in such a way that the position sensor 47 senses the first shutter plate 41 after a predetermined period has passed from the start of the drive of the carriage 2, and then following it if the position sensor 47 senses both of the movable shutter plate 42 and the second shutter plate 43 within another predetermined period, the carriage 2 is stopped at the home position shown in FIG. 5*b* with the lapse of the latter predetermined period. In this manner, when the initial setting of the carriage 2 and the initial setting of the cassette holder 3 are confirmed, and then the printing operation is started in known manner. However, if the cassette holder 3 is in a position other than the home position of said holder, and as a result the movable shutter plate 42 is lifted up from between the first and the second shutter plates 41, and 43 as shown in FIG. 8, since the position sensor 47 senses only the second shutter plate 43 within a predetermined period after sensing the first shutter plate 41, the control sequence of the carriage 2 moves said carriage 2 to the specified position beyond the end point of the operation of said carriage 2 thereby operating the cassette tilt arrangement described with reference to FIG. 4*a* to FIG. 4*d* to carry out the shift of one step of the cassette holder 3. Thereafter, said carriage 2 is driven for a predetermined period so as to return it again to the position shown in FIG. 5*a*, and following it the operation similar to the operation described above is performed. This operation is repeated until both the carriage 2 and the cassette holder 3 reach the respective home positions.

Figure 6A:
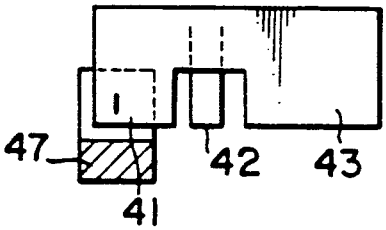
FIGS. 6*a*, 6*b*, and 6*c* are side views illustrating the movement of the carriage until the carriage reaches the home position in the case when part of the carriage is on the sensor.
Figure 6B:
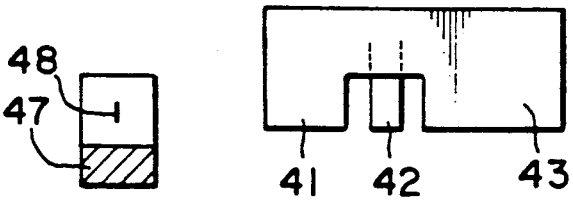
Figure 6C:
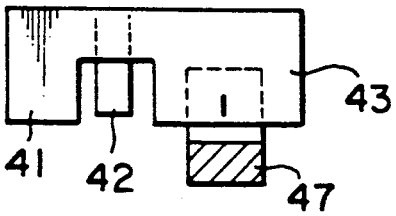

Although FIG. 6*a* shows the state wherein the first shutter plate 41 is positioned before the position sensor 47, in this case, similarly to the above case, the instance wherein the cassette holder 3 is already in the home position is described first. When the power source is switched on, and it is confirmed that the position sensor 47 is in the operating state, the control sequence of the carriage 2 drives said carriage 2 for a predetermined period so that the carriage 2 may be moved to a position away from the position sensor 47. Thereby the carriage 2 is moved to the position shown in FIG. 6*b* similar to FIG. 5*a*, and is then moved to the home position shown in FIG. 6*c* similar to FIG. 5*b*. Although the description made so far is directed to the state wherein the first sensor shutter plate 41 is positioned before the position sensor 47, the same operation is done in the case wherein instead of the first shutter plate 41, the movable shutter plate 42 or the second shutter plate 43 is positioned. On the other hand, when the cassette holder 3 is not positioned in the home position, the process of the initial setting of the cassette holder 3 to reach the home position from a position other than the home position will be understood easily when the above description made with reference to FIG. 5*a* and FIG. 5*b* is considered.

Figure 7A:
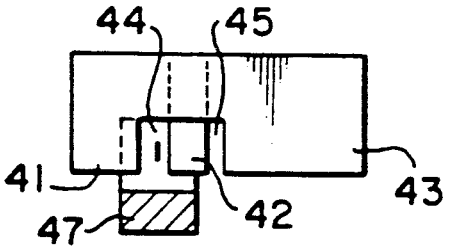
FIGS. 7*a*, 7*b*, 7*c*, and 7*d* are side views illustrating the movement of the carriage that is located at a little different position from shown in FIG. 6*a*. until the carriage reaches the home position.
Figure 7B:
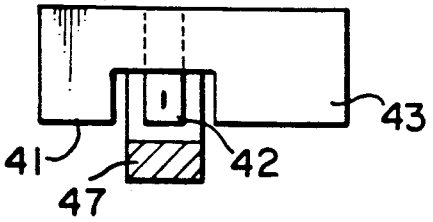
Figure 7C:
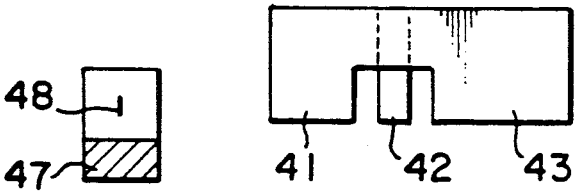
Figure 7D:
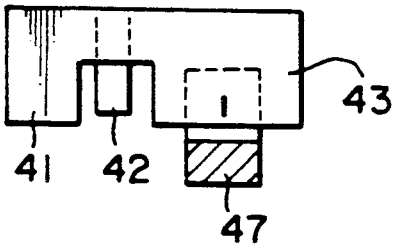

FIG. 7*a* shows the case wherein the cassette holder 3 is in the home position, and the gap 44 between the first shutter plate 41 and the movable shutter plate 42 is present before the position sensor 47. In this state, when the power source is switched on, and it is discerned that the position sensor 47 is in the nonoperating state, although the control sequence of the carriage 2 drives the carriage 2 to the left as in the case shown in FIG. 5*a*, in this case since the position sensor 47 senses the movable shutter plate 42 within a short period from the start of the drive of the carriage 2, the change in the state of the position sensor 47 within the prescribed short period is discerned, and thereby the carriage 2 is stopped once (FIG. 7*b*). Thereafter, the carriage 2 is moved in the reverse direction for a predetermined period, then when said carriage 2 reaches the position shown in FIG. 7*c* similar to FIG. 5*a*, it is moved in the reverse direction again, and when it reaches the home position shown in FIG. 7*d*, it is stopped in the operating manner described with reference to FIG. 5*b*. Such an initial setting process is also carried out in the same manner in the case wherein the gap 45 between the movable shutter plate 42 and the second shutter plate 43 is present before the position sensor 47. In the case wherein the cassette holder 3 is in a position other than the home position, the movable shutter plate 42 is lifted up, the wide gap 49 is formed between the first shutter plate 41 and the second shutter plate 43 as shown in FIG. 8, and the sensor 47 is opposed in the wide gap 49, it will be readily understood that in addition to the initial setting process of the carriage illustrated in FIG. 7*a* to FIG. 7*d*, the initial setting process of the cassette holder 3 described with reference to FIG. 5*b* is carried out to perform a series of combined processes.

If the carriage 2 is positioned quite near the position sensor 47, in other words, if the distance between the position sensor 47 and the carriage 2 in FIG. 5*a* is equal to or smaller than the gap 49 between the first shutter plate 41, and the second shutter plate 43, since the position sensor 47 senses the first shutter plate 41 within a predetermined short period from the start of the leftward movement of the carriage 2, the operation corresponding to that of from FIG. 7*a* to FIG. 7*d* is carried out.

As apparent from the above description, according to the present invention, in the case when the carriage 2 is moved toward the position sensor 47, said position sensor 47 senses the first shutter plate 41, and following it both the movable shutter plate 42 and the second shutter plate 43 are sensed within a predetermined period, it is discerned that the cassette holder 3 and the carriage 2 are present in the respective home positions, and after a predetermined period has passed, the carriage 2 is stopped. In this case, the movable shutter plate 42 is coactively moved with the cassette holder 3, and when the cassette holder 3 is in a position other than the home position, since the movable shutter plate 42 is removed from between the first shutter plate 41 and the second shutter plate 43, the position sensor 47 senses only the second shutter plate 43 within said predetermined period, so that it is discerned that the cassette holder 3 is not present in the home position. If the cassette holder 3 is not present in the home position, the carriage 2 is moved to the specified position beyond the operating point, then after an increment of the tilt position of the cassette holder 3 is added, the same operation as before is carried out, and this series of operations is repeated until it is discerned that the cassette holder 3 and the carriage 2 are present in the respective home positions. In this manner, the initial setting of the respective home positions of the cassette 3 and the carriage 2 is made by the single position sensor 47.

What is claimed is:

1. A serial printer comprising a platen, a printing head opposed to said platen, a carriage carrying said printing head and reciprocatable along said platen, a cassette holder for removably carrying an ink ribbon cassette on said carriage and tiltably mounted on said carriage to move said ink ribbon cassette in a direction vertical to said platen and having a leg extending therefrom, a cam mechanism operatively connected to said cassette holder on said carriage, and a drive cam mechanism for driving said cam mechanism, a. said cam mechanism including a cam wheel having a spirally extending ramp edge, and a cam follower that engages with said ramp edge for selectively moving said cassette holder between multi-stable positions along with the movement of said cam wheel, said cam follower having a first lip engaged with said ramp edge and a second lip engaged with the leg extending from the cassette holder, and b. said cam drive mechanism including a ratchet wheel having a plurality of ratchets and coaxially supported on said carriage together with said cam wheel, two drive levers slidably mounted on said carriage to slide in opposite directions, said drive levers being normally resiliently biased into a first position with one end operatively engaged with ratchets of said ratchet wheel, and two abutting plates fixed at opposite side sections of said printer and abutting the other end of the respective drive levers when said carriage is moved to specified positions beyond operating end points to move said drive levers to a second position and thereby cause the one end of said drive levers to drive said ratchet wheel.

2. In a printer having a platen: a carriage movable along the platen between two operating end points; a holder mounted on the carriage for holding a ribbon cassette; and means for tilting the cassette about an axis parallel to the platen comprising a cam mechanism including a cam wheal rotatably mounted on the carriage and having a spiral cam edge, a cam follower having a first portion engaged with the cam edge and a second portion engaged with the holder and responsive to the rotation of the cam wheel into one of a plurality of angular positions to move the cam follower and thereby the holder into one of a plurality of stable tilt positions, and means for driving the cam mechanism comprising a ratchet wheel rotatable with the cam wheel and having a plurality of ratchets each corresponding to one of the angular positions, two drive levers each having two ends, means slidably mounting the two drive levers on the carriage, means normally biasing the two drive levers into one position wherein one end thereof is engaged with one of the ratchets, and two abutting plates fixed to opposite sides of the printer and engageable by the other end of the respective drive levers when the carriage moves beyond the operating end points to slide the drive levers and rotate the ratchet wheel and the cam wheel into another of the plurality of angular positions.

* * * * *